US006394078B1

(12) United States Patent
Kling

(10) Patent No.: US 6,394,078 B1
(45) Date of Patent: May 28, 2002

(54) INTERNAL-COMBUSTION ENGINE HAVING A VENTILATION SYSTEM

(75) Inventor: Jürgen Kling, Wiernsheim (DE)

(73) Assignee: Dr. Ing. h.c.F. Porsche AG, Weissach (DE)

( * ) Notice: Subject to any disclaimer, the term of this patent is extended or adjusted under 35 U.S.C. 154(b) by 0 days.

(21) Appl. No.: 09/606,060

(22) Filed: Jun. 29, 2000

(30) Foreign Application Priority Data

Jun. 29, 1999 (DE) ..... 199 29 876

(51) Int. Cl.[7] ..... F01M 13/04
(52) U.S. Cl. ..... 123/572
(58) Field of Search ..... 123/572, 573, 123/574, 41.86

(56) References Cited

U.S. PATENT DOCUMENTS

| | | | | |
|---|---|---|---|---|
| 4,901,703 A | | 2/1990 | Humphries | |
| 4,962,745 A | * | 10/1990 | Ohno et al. | 123/572 |
| 5,205,265 A | | 4/1993 | Kashiyama et al. | |
| 5,456,239 A | | 10/1995 | Henderson et al. | |
| 5,499,616 A | * | 3/1996 | Enright | 123/572 |
| 6,112,707 A | * | 9/2000 | Kirk | 123/572 |

FOREIGN PATENT DOCUMENTS

| | | |
|---|---|---|
| DE | 2209909 | 10/1973 |
| DE | 88 09 973 U | 11/1988 |
| DE | 19709910 | 9/1998 |
| EP | 0 220 886 B1 | 12/1990 |
| JP | 60-81416 | 4/1985 |

* cited by examiner

*Primary Examiner*—Marguerite McMahon
(74) *Attorney, Agent, or Firm*—Crowell & Moring LLP

(57) ABSTRACT

An internal-combustion engine is equipped with a ventilation system which is used for ventilating the crankcase. The ventilation system cooperates with an oil separator, is connected with an intake pipe and, furthermore, is provided with throttles. For expanding the application range and optimizing the effect of the ventilation system, the latter comprises the crankcase ventilation and a turbocharger ventilation, the crankcase ventilation and the turbocharger ventilation being connected to a distributor unit assigned to the oil separator. The distributor unit has a first throttle and a second throttle. In this case, with the insertion of the oil separator, the first throttle is connected with a first pipe connected to the intake pipe; the second throttle is connected with the intake pipe by way of a second pipe. In the suction operation, the ventilation system operates by way of the second pipe and, in the charger operation, it operates by way of the first pipe.

15 Claims, 1 Drawing Sheet

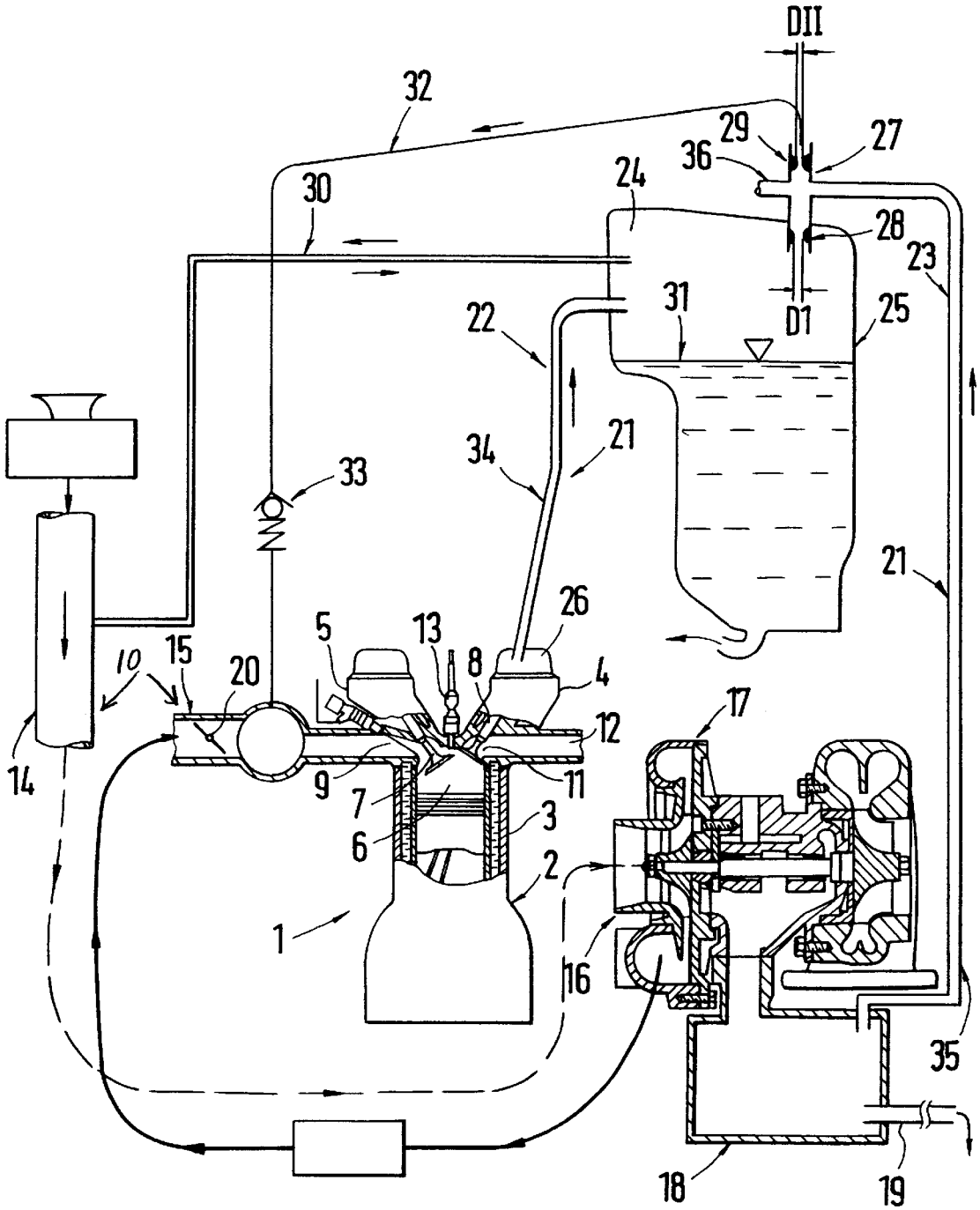
DII
32
29
27
36
24
30
28
23
31
D1
25
22
21
34
33
21
26
5
13
8
4
10
15
20
12
17
14
9
11
7
3
6
2
1
16
35
18
19

INTERNAL-COMBUSTION ENGINE HAVING A VENTILATION SYSTEM

BACKGROUND AND SUMMARY OF THE INVENTION

This application claims the priority of Patent Document 199 29 876.9, filed Jun. 29, 1999, the disclosure of which is expressly incorporated by reference herein.

The invention relates to an internal-combustion engine having a ventilation system which is used for crankcase ventilation, interacts with an oil separator and is connected to an intake pipe of the internal-combustion engine and furthermore is equipped with throttles.

A crankcase ventilation for an internal-combustion engine is known—German Patent Document DE 197 09 910 A1—in the case of which ventilation medium from a crankcase and a cylinder head is supplied to oil separators and, freed of oil, is transmitted to an intake pipe. In addition, this crankcase ventilation system is provided with a partial load ventilation as well as a full-load ventilation, and has throttles.

Furthermore, an arrangement is known for avoiding lubricant losses in the case of an exhaust gas turbocharger—German Patent Document DE 22 09 909 C2, in the case of which a ventilation pipe is provided between a lubricant space and an intake pipe.

It is an object of the invention to provide a simple but highly effective design for a ventilation system of an internal-combustion engine with a turbocharging system.

According to the invention, this object is achieved by providing a ventilation system for an internal-combustion engine having a ventilation device which is used for crankcase ventilation, interacts with an oil separator and is connected to an intake pipe of the internal-combustion engine and furthermore is equipped with throttles, wherein the ventilation system comprises a crankcase ventilation as well as a turbocharger ventilation of at least one turbocharger, wherein the crankcase ventilation and the turbocharger ventilation are connected to a distributor unit assigned to the oil separator, which distributor unit has a first throttle and a second throttle, the first throttle, being connected by a first pipe with an intake pipe section leading to the turbocharger, and the second throttle being connected by a second pipe to the intake pipe section leading to the engine combustion space such that the ventilation system operates in the suction operation by way of the second pipe but in the charger operation by way of the first pipe.

Further features of preferred embodiments are described below and in the claims.

Principal advantages achieved by means of the invention are that the combination of the crankcase ventilation and the turbocharger ventilation creates an excellently operating ventilation system of an internal-combustion engine equipped with a turbocharging system, which utilizes throttles which can be easily implemented. Because of these throttles, the two operating modes, that is, the suction operation—vacuum—and the charger operation—excess pressure—can advantageously be taken into account, the smaller diameter of the second throttle ensuring that the provided rotational idling speed is maintained. Together with the distributor unit, the throttles form a constructional unit which is easy to produce. The oil separator, which cooperates with the ventilation system, can be assigned to an oil tank of a dry sump system as well as to an internal-combustion engine casing, for example, a cylinder head.

Other objects, advantages and novel features of the present invention will become apparent from the following detailed description of the invention when considered in conjunction with the accompanying drawings.

BRIEF DESCRIPTION OF THE DRAWINGS

The single drawing FIGURE is a schematic FIGURE of an internal-combustion engine with a ventilation system constructed according to a preferred embodiment of the invention,

DETAILED DESCRIPTION OF THE DRAWINGS

An internal-combustion engine 1 comprises a crankcase 2 with integrated cylinders 3 and cylinder heads 4, 5. The gas movements in a combustion space 6 of the internal-combustion engine 1 are controlled by inlet valves 7 and outlet valves 8. The inlet valves 7 operate at an output 9 of the intake pipe; the outlet valves 8 operate at an input 11 of an outlet pipe 12. Reference number 13 indicates a spark plug which ignites a fuel-air mixture in the combustion space 6. The intake pipe assembly 10 has a first pipe section 14 and a second pipe section 15. The first pipe section 14 guides atmospheric fresh air to a compressor 16 of a turbocharger 17 which is provided with an oil tank 18 receiving lubricant of the above-mentioned turbocharger. The oil tank 18 is connected by means of a pipe 19 to a suction pump which is not shown. From the compressor 16, the precompressed air is conveyed into the second pipe section 15. A throttle valve 20 is arranged in the second pipe section 15, specifically at a defined distance from the inlet valve 7 and the output 9.

Furthermore, the internal-combustion engine 1 is provided with a ventilation device 21 which comprises a crankcase ventilation system 22 for blow-by gases and a turbocharger ventilation system 23. Both interact with an oil separator 24 which constructively is not shown in detail and which, in the embodiment, is a component of an oil tank 25 of a dry sump system. However, it is also conceivable to integrate the oil separator in the internal-combustion engine 1, specifically into a valve cover 26 of the cylinder heads 4, 5.

The crankcase ventilation system 22 for blow-by gases and the turbocharger ventilation system 23 are connected to a distributor unit 27 which is assigned to the oil separator 24. The distributor unit 27 comprises a first throttle 28 and a second throttle 29, whose smallest diameters DI and DII have different sizes, specifically DI>DII. In the embodiment shown, the diameter DI of the first throttle 28 is between 2.8 and 3.2 mm; the diameter DII of the second throttle 29 is 1.3 to 1.7 mm.

Furthermore, the first throttle 28, with the intermediate connection of the oil separator 24, is connected by means of a first pipe 30, which leads away above an oil level 31 from the oil tank 25, to the first pipe section 14 of the intake pipe assembly 10, whereas the second throttle 29 is connected by means of a second pipe 32 to the second pipe section 15 of the intake pipe assembly 10. The second pipe 32, into which a return valve 33 is connected, is connected between the throttle valve 20 and the output 9 to the second pipe section 15 of the intake pipe assembly 10.

A third pipe 34 of the crankcase ventilation system 21 is placed between the cylinder head 4 and the oil tank 25. The pipe 34 leads above the oil level 31 into the oil tank 25. Finally, a fourth pipe 35 of the turbocharger ventilation system 23 connects the oil tank 18 with the distributor unit 27; a fifth pipe 36 will be required if the turbocharger ventilation system, as indicated in the embodiment, is effective for two turbochargers.

The distributor unit 27, together with the throttles 28, 29, may be a prefabricated construction unit which can be fastened on the oil tank 25.

During the operation of the internal-combustion engine 1 in the partial load range or the suction operation, the second pipe 32 is active; that is, the ventilation medium enters, by way of the third pipe 34, into the oil separator 24, from where—largely freed of oil—it arrives by way of the first throttle 28 and the second throttle 29 in the second pipe 32. The return valve 33 is open, so that this medium is guided back into the first pipe section 14 of the intake pipe assembly 10. Simultaneously, corresponding medium arrives by way of the fourth pipe 34 as well as the fifth pipe 35 and the second throttle 29 in the second pipe 32.

As soon as the charger operation of the internal-combustion engine 1 starts, for example, at a full load, the return valve 33 is blocked because of the excess pressure conditions existing in the intake pipe assembly 10. Behind the oil separator 24, the ventilation media of the crankcase ventilation system 22 and of the turbocharger ventilation system 23 arrive in the regenerated condition by way of the first pipe 30 in the first pipe section 14 of the intake pipe assembly 10.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. Ventilation system for an internal-combustion engine, having a ventilation device which is used for crankcase ventilation, which interacts with an oil separator and is connected to an intake pipe of the internal-combustion engine and furthermore is equipped with throttles, wherein the ventilation system comprises a crankcase ventilation as well as a turbocharger ventilation of at least one turbocharger, wherein the crankcase ventilation and the turbocharger ventilation are connected to a distributor unit assigned to the oil separator, which distributor unit has a first throttle and a second throttle, the first throttle, being connected with an intake pipe section leading to the turbocharger by a first pipe, and the second throttle being connected by a second pipe to the intake pipe section leading to the engine combustion space such that the ventilation system operates in the partial load range by way of the second pipe but at full load by way of the first pipe.

2. Ventilation system according to claim 1, wherein a return valve is connected into the second pipe.

3. Ventilation system according to claim 1, wherein the turbocharger ventilation takes place from an oil tank of the turbocharger and a pipe is provided between the oil tank and the distributor unit.

4. Ventilation system according to claim 1, wherein the distributor unit and the throttles form a prefabricated constructional unit.

5. Ventilation system according to claim 1, wherein the smallest diameters of the first and of the second throttle have different sizes such that the diameter of the first throttle is larger than the diameter of the second throttle.

6. Ventilation system according to claim 5, wherein the diameter of the first throttle is between 2.6 to 3.4 mm, and the diameter of the second throttle is between 1.3 to 1.7 mm.

7. Ventilation system according to claim 1, wherein the turbocharger system has two turbochargers, and wherein the turbocharger ventilation of both turbochargers is connected to the ventilation system.

8. Ventilation system according to claim 1, wherein the oil separator is a component of an oil tank of a dry sump lubrication system of the internal-combustion engine.

9. Ventilation system according to claim 1, wherein the oil separator is a component of an internal-combustion engine case, for example, of the cylinder head.

10. Ventilation system according to claim 2, wherein the turbocharger ventilation takes place from an oil tank of the turbocharger and a pipe is provided between the oil tank and the distributor unit.

11. Ventilation system according to claim 10, wherein the turbocharger ventilation takes place from an oil tank of the turbocharger and a pipe is provided between the oil tank and the distributor unit.

12. Ventilation system according to claim 10, wherein the smallest diameters of the first and of the second throttle have different sizes such that the diameter of the first throttle is larger than the diameter of the second throttle.

13. Ventilation system according to claim 12, wherein the diameter of the first throttle is between 2.6 to 3.4 mm, and the diameter of the second throttle is between 1.3 to 1.7 mm.

14. Internal combustion engine assembly comprising:

an engine crankcase, an engine turbocharger oil tank, an oil separator, and a ventilation system including a distribution unit assigned to the oil separator, wherein the distribution unit is operable to selectively connect a ventilation space in the oil separator with a turbocharger intake air line and an engine combustion space intake air line as a function of engine operation with and without turbocharging.

15. Internal combustion engine assembly comprising:

an engine crankcase, an engine turbocharger oil tank, an oil separator with a ventilation space, and a ventilation system including a distribution unit assigned to the oil separator, wherein the ventilation system includes means operable to selectively connect the ventilation space with a turbocharger intake air line and an engine combustion space intake air line as a function of engine operation with and without turbocharging.

* * * * *